US010022737B2

(12) United States Patent
Yoo et al.

(10) Patent No.: US 10,022,737 B2
(45) Date of Patent: Jul. 17, 2018

(54) COSMETIC CONTAINER COMPRISING PUSH BUTTON HAVING RESILIENT UPRIGHT NOZZLE

(71) Applicant: AMOREPACIFIC CORPORATION, Seoul (KR)

(72) Inventors: Chang Gyu Yoo, Seoul (KR); Ju Ho Kim, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 0 days.

(21) Appl. No.: 14/650,836

(22) PCT Filed: Jan. 8, 2014

(86) PCT No.: PCT/KR2014/000178
§ 371 (c)(1),
(2) Date: Jun. 9, 2015

(87) PCT Pub. No.: WO2014/109531
PCT Pub. Date: Jul. 17, 2014

(65) Prior Publication Data

US 2015/0314311 A1 Nov. 5, 2015

(30) Foreign Application Priority Data

Jan. 11, 2013 (KR) ..... 20-2013-0000249 U

(51) Int. Cl.
*B67D 7/58* (2010.01)
*B05B 11/00* (2006.01)
(Continued)

(52) U.S. Cl.
CPC ..... *B05B 11/3001* (2013.01); *A45D 40/0075* (2013.01); *B05B 11/0091* (2013.01);
(Continued)

(58) Field of Classification Search
CPC ..... B05B 11/3001; A45D 40/0075
(Continued)

(56) References Cited

U.S. PATENT DOCUMENTS 6,613,183 B2 * 9/2003 Dewitt ..... B27G 11/00 156/305
7,431,181 B2 * 10/2008 Masuda ..... B05B 11/007 222/256
(Continued)

FOREIGN PATENT DOCUMENTS

WO WO 2013017801 A1 * 2/2013 ..... A45D 34/04

*Primary Examiner* — Jeremy W Carroll
(74) *Attorney, Agent, or Firm* — Heedong Chae; Lucem, PC

(57) ABSTRACT

Disclosed is a cosmetics container with a push button having a flexible upright nozzle in which a push button having an upright nozzle a discharge opening of which faces upwards is mounted to the cosmetics container such that the residual cosmetic contents left in the nozzle do not flow through the discharge opening and the flexible upright nozzle is easily bent during use thereof such that the discharge opening faces a lateral side. The cosmetics container includes: a container body filled with cosmetic contents and having a mouth; an airless pump mounted to the mouth of the container body to pump the cosmetic contents and having a discharge passage through which the cosmetic contents are discharged; and a shoulder for fixing the airless pump to the mouth of the container body and preventing leakage of the cosmetic contents from the container body, wherein a push button is coupled to the discharge passage of the airless passage, a nozzle is formed uprightly in the push button such that a discharge opening from which the cosmetic contents are discharged faces upwards, and the nozzle is formed of a flexible material.

7 Claims, 7 Drawing Sheets

(51) Int. Cl.
*A45D 40/00* (2006.01)
*A45D 34/00* (2006.01)

(52) U.S. Cl.
CPC ..... *B05B 11/3052* (2013.01); *A45D 34/00* (2013.01); *A45D 2200/056* (2013.01); *B05B 11/0037* (2013.01); *B05B 11/0048* (2013.01); *B05B 11/3047* (2013.01); *B05B 11/3097* (2013.01)

(58) Field of Classification Search
USPC ..... 222/383.1, 256, 383.3, 526–529
See application file for complete search history.

(56) References Cited

U.S. PATENT DOCUMENTS

| | | | | |
|---|---|---|---|---|
| 2006/0065677 | A1* | 3/2006 | Py | A45D 34/04 222/383.1 |
| 2007/0075097 | A1* | 4/2007 | Behar | B65D 83/205 222/256 |
| 2009/0014481 | A1* | 1/2009 | Benetti | B05C 17/00516 222/563 |
| 2010/0224652 | A1* | 9/2010 | Lim | A45D 34/04 222/256 |
| 2010/0243677 | A1* | 9/2010 | Lim | A45D 34/04 222/256 |
| 2013/0026191 | A1* | 1/2013 | Duquet | B01L 3/0265 222/256 |
| 2014/0239017 | A1* | 8/2014 | Von Schuckmann | B05B 11/0048 222/207 |

* cited by examiner

Prior Art

COSMETIC CONTAINER COMPRISING PUSH BUTTON HAVING RESILIENT UPRIGHT NOZZLE

BACKGROUND OF THE INVENTION

1. Field of the Invention

The present invention relates to a cosmetics container with a push button, having a flexible upright nozzle, and more particularly to a cosmetics container with a push button having a flexible upright nozzle in which a push button having an upright nozzle a discharge opening of which faces upwards is mounted to the cosmetics container such that the residual cosmetic contents left in the nozzle do not flow through the discharge opening and the flexible upright nozzle is easily bent during use thereof such that the discharge opening faces a lateral side.

2. Description of the Prior Art

In general, as shown in FIG. 1, in a cosmetics container including a push button, a discharge opening of a nozzle faces a lateral side such that a pump in the cosmetics container is operated by pushing an upper portion of the push button downwards to discharge cosmetic contents through the discharge opening of the nozzle and the push button returns upwards to an original state by a resilient member if a force pressing the push button is removed, in which case the discharge opening of the nozzle always faces a lateral side and is opened to the outside so that residual cosmetic contents left in the nozzle flow out through the discharge opening due to gravity, contaminating a periphery of the cosmetics container dustily.

In view of the problems, the applicant devised Korean Utility Model No. 408019 that, relates to a discharge nozzle structure of a discharge pump by which air can be blocked. According to the utility model, if an opening/closing rod for selectively opening or blocking an inlet of a nozzle tube of the discharge nozzle through which contents are discharged presses a push button of the discharge pump, a mouth of the nozzle tube is opened snob that, contents can be discharged, and when the push button of the discharge pump is not operated, the mouth of the nozzle tube is blocked such that the contents existing in the nozzle tube does not flow down so that the contents are not dried. However, according to the utility model, since the push button and the opening/closing rod in the nozzle tube cooperate with each other, the structure of the discharge nozzle structure is complex and manufacturing costs are high.

In order to avoid the complex structure and prevent contents in the nozzle from flowing down, Korean Utility Model No. 230226 was suggested. In this utility model, an opening/closing member is simply installed at a front end of a nozzle such that residual contents in the nozzle are prevented from flowing down by closing a discharge opening of the nozzle after the contents are discharged. However, according to the utility model, since a front end of the nozzle should be covered to couple the opening/closing member after the contents are discharged to be used, it is inconvenient to use it and the contents in the nozzle flow out and contaminate a periphery of the cosmetics container if it is forgotten to cover a front end of the nozzle with the opening/closing member.

Accordingly, the applicant suggested an invention regarding a nozzle head for a fluid dispenser in Korean Patent Application No. 2011-12056. According to the nozzle head, a silicon nozzle for discharging contents as a discharge opening is opened by an internal pressure during a pumping operation is coupled to a front end of a push button such that the discharge opening is closed due to the resiliency of the silicon nozzle after the discharge opening of the silicon nozzle is opened only when the contents are discharged. However, according to the invention, since a separate silicon nozzle is coupled to the front end of the push button by the fixing member, the number of part is large and manufacturing costs are high due to an additional assembly process.

SUMMARY OF THE INVENTION

The present invention has been made in an effort, to solve the above-described problems, and it is an object of the present invention to provide a cosmetics container with a push button having a flexible upright nozzle by which a push button is tanned such that a flexible nozzle is upright, so that manufacturing costs become lower and a periphery of the cosmetics container can foe prevented from being contaminated due to residual contents in the nozzle by preventing the residual cosmetic contents left in the nozzle from flowing out through a discharge opening without using an additional part other than the push button, whereby in-use convenience and cleanness can be improved.

In accordance with an aspect of the present invention, there is provided a cosmetics container with a push button having a flexible upright nozzle, the cosmetics container including: a container body 10 filled with cosmetic contents and having a mouth 16;

an airless pump 20 mounted to the mouth 16 of the container body 10 to pump the cosmetic contents and having a discharge passage 22 through which the cosmetic contents are discharged; and a shoulder 30 for fixing the airless pump 20 to the mouth 10 of the container body 10 and preventing leakage of the cosmetic contents from the container body, wherein a push button 40 is coupled to the discharge passage 42 of the airless passage, a nozzle 44 is formed uprightly in the push button such that a discharge opening from which the cosmetic contents are discharged faces upwards, and the nozzle 44 is formed of a flexible material.

The nozzle 44 may be formed of one of nitrile rubber (NBR), natural rubber (NR), silicon rubber, and butadiene rubber (BR).

The nozzle 44 and the push button 40 may be formed of a same flexible material or only the nozzle 44 may be formed of a flexible material and the push button is formed by using an in-mold injection mold, and the nozzle and the push button may formed of different materials through a dual, injection-molding method or the nozzle 44 and the push button 40 may be separately injection-molded and then are assembled.

Boss rings 46 or bosses 48 may be formed on surfaces of the nozzle and the push button such that, a finger is not slid when the nozzle 44 and the push button 40 are pushed by the finger.

The cosmetics container may further include an inner container having a cylindrical shape one side of which is opened, and a piston for wiping the cosmetic contents in the inner container is coupled to the inner container.

An auxiliary shoulder for easily coupling the airless pump may be further provided between the shoulder and the mouth of the container body.

A cover for preventing introduction of foreign substances may be coupled to upper sides of the push button and the shoulder.

According to the cosmetics container with a push button having a flexible upright nozzle, a push button is formed such that a flexible nozzle is upright, so that manufacturing costs become lower and a periphery of the cosmetics container can be prevented from being contaminated due to residual contents in the nozzle by preventing the residual cosmetic contents left in the nozzle from flowing out through a discharge opening without using an additional part other than the push button, whereby in-use convenience and cleanness can be improved.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THIS PREFERRED EMBODIMENTS

Figure 1:
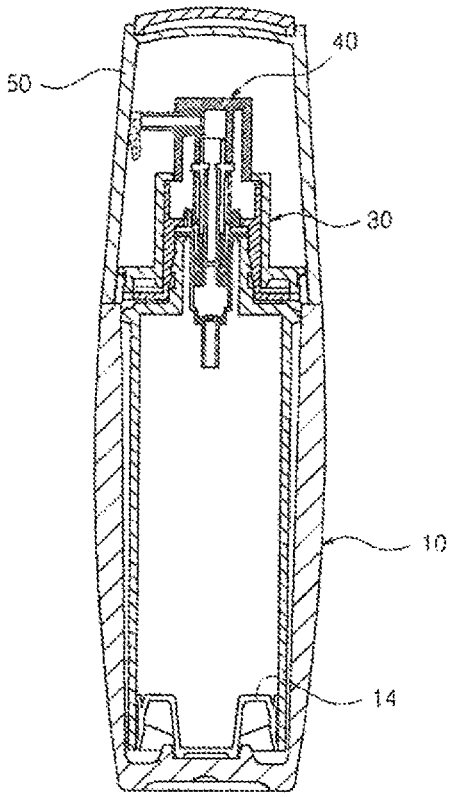
FIG. 1 is a sectional view of a cosmetics container with a push button according to the related art.

Hereinafter, exemplary embodiments of the present invention will be described with reference to the accompanying drawings. In the following description, the same elements will be designated by the same reference numerals although they are shown in different drawings. Further, in the following description of the present invention, a detailed description of known functions and configurations incorporated herein will be omitted when it may make the subject matter of the present invention rather unclear.

Further, the following terms are those defined, considering the functions of the present invention, and may be changed according to the intentions of the user or the manager or the customs. Therefore, the definitions of the terms should be made based on the contents of the specification.

Figure 2:
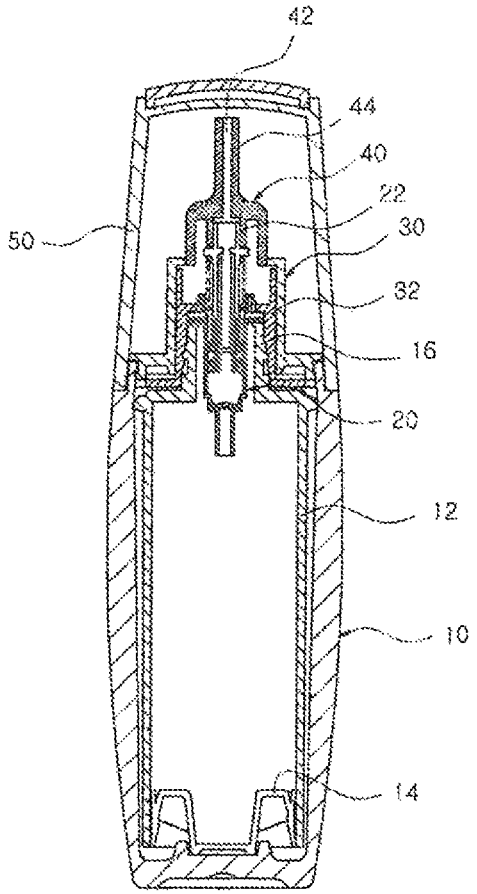
FIG. 2 is a sectional view of a cosmetics container with a posh button having a flexible upright nozzle according to an embodiment of the present invention.
Figure 3A:
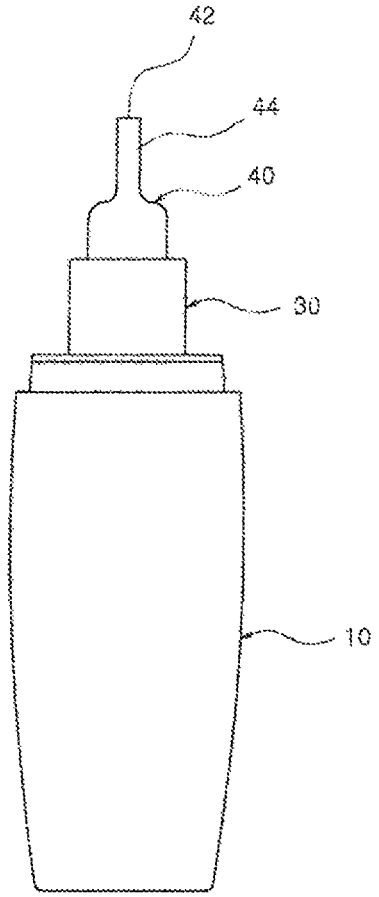
FIG. 3A is a front view of the cosmetics container with a push button having a flexible upright nozzle according to the embodiment of the present invention.
Figure 3B:
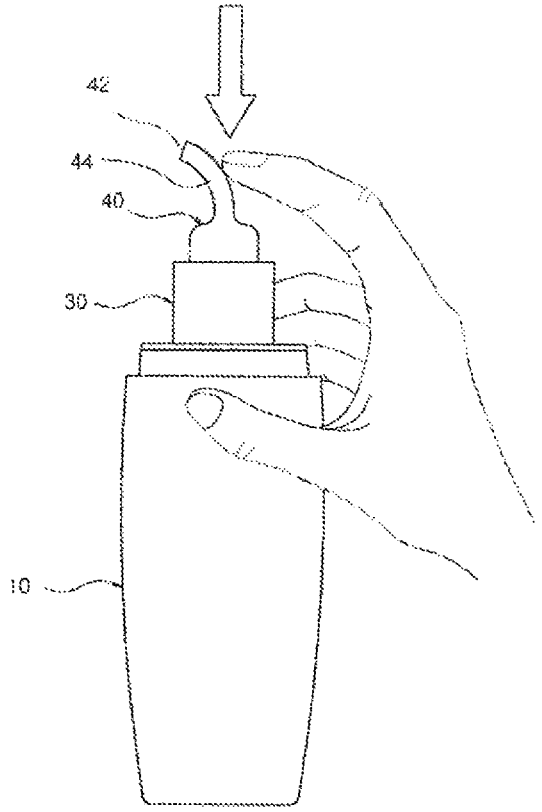
FIG. 3B is a front view of the cosmetics container with a push button having a flexible upright nozzle according to the embodiment of the present, invention when the push button starts to be pushed.
Figure 3C:
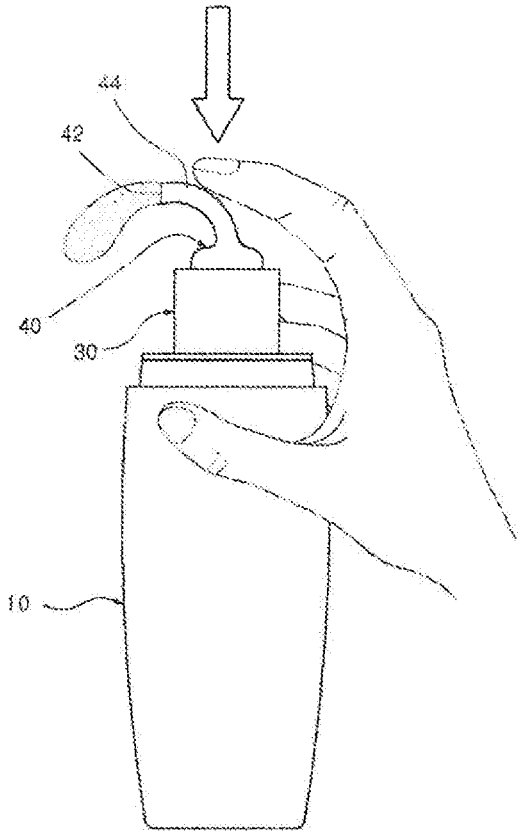
FIG. 3C is a front view of the cosmetics container with a push button having a flexible upright nozzle according to the embodiment of the present invention when the push button is completely pushed.
Figure 4A:
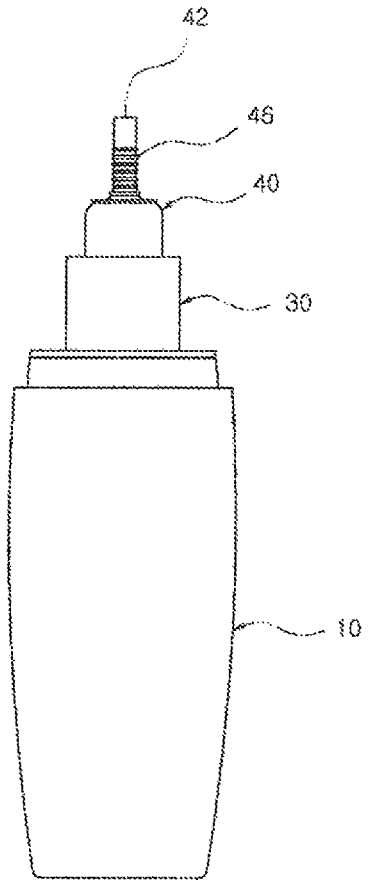
FIG. 4A is a front view of a cosmetics container with a push button having a flexible upright nozzle according to another embodiment of the present invention.
Figure 4B:
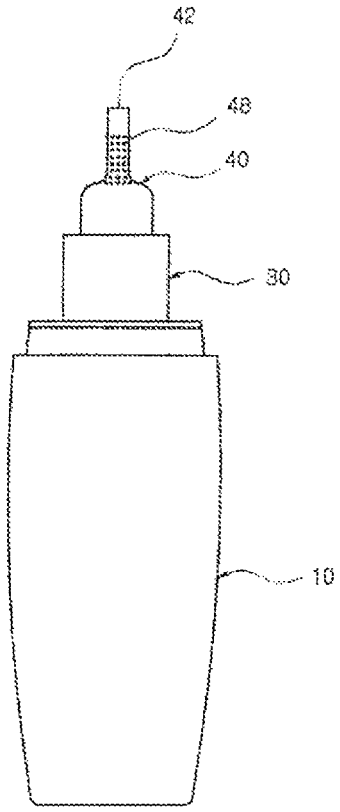
FIG. 4B is a front view of a cosmetics container with a push button having a flexible upright nozzle according to still another embodiment of the present invention.

FIG. 2 is a sectional view of a cosmetics container with a push button having a flexible upright nozzle according to an embodiment of the present invention. FIG. 3A is a front view of the cosmetics container with a push button having a flexible upright nozzle according to the embodiment of the present invention. FIG. 3B is a front view of the cosmetics container with a push button having a flexible upright nozzle according to the embodiment of the present invention when the push button starts to be pushed. FIG. 3C is a front view of the cosmetics container with a push button having a flexible upright nozzle according to the embodiment of the present invention when the push button is completely pushed. FIG. 4A is a front view of a cosmetics container with a push button having a flexible upright nozzle according to smother embodiment of the present invention. FIG. 4B is a front view of a cosmetics container with a push button having a flexible upright nozzle according to still another embodiment of the present invention.

The cosmetics container with a push button having a flexible upright nozzle according to the present invention includes: a container body 10 filled with cosmetic contents and having a mouth 16; an airless pump 20 mounted to the mouth 16 of the container body 10 to pump the cosmetic contents and having a discharge passage 22 through which the cosmetic contents are discharged; and a shoulder 30 for fixing the airless pump 20 to the mouth 16 of the container body 10 and preventing leakage of the cosmetic contents from the container body 10. A push button 40 is coupled to the discharge passage 22 of the airless passage 20, a nozzle is formed uprightly in the push button 40 such that a discharge opening 42 from which the cosmetic contents are discharged faces upwards, and the nozzle 44 is formed of a flexible material.

Since the nozzle 44 is normally formed uprightly such that the discharge opening 42 faces upwards and is bent only when the cosmetic contents are discharged to foe used by pressing a portion of the nozzle 44 and the push button 40 such that, the discharge opening 42 faces a lateral side, the nozzle 44 should foe formed of a flexible material. Thus, it is preferable that the material of the nozzle 44 is formed of one of nitrile rubber (NBR), natural rubber (NR), silicon rubber, and butadiene rubber (BR).

As shown in FIG. 1, according to the conventional cosmetics container having a nozzle, if the cosmetics container is left alone after cosmetic contents are discharged and used, the cosmetic contents left in the nozzle and the push button flow down through the discharge opening due to gravity. Thus, the cosmetic contents contaminate a periphery of the cosmetics container dustily, and if the cosmetic contents are left alone for a long time, they are decomposed, sticking to skin and thus causing a skin trouble such as a skin eruption.

According to the present invention, as shown in FIG. 2, since the flexible nozzle 44 is erected and the discharge opening 42 faces upwards after the cosmetic contents are discharged and used, the cosmetic contents left in the nozzle 44 and the push button 40 are prevented from flowing out and thus are prevented from contaminating a periphery of the cosmetics container.

In forming the nozzle 44, the nozzle 44 and the push button 40 may be formed of the same flexible material or only the nozzle 44 is formed of a flexible material and the push button 40 may be formed by using an in-mold injection mold. Further, the nozzle 44 and the push button 40 may be formed of different materials through a dual injection-molding method or the nozzle 44 and the push button 40 may be separately injection-molded and then may be assembled.

According to the cosmetics container of the present invention, when the push button 40 is pushed such that the cosmetic contents are discharged and used, a lower portion of the nozzle 44, that is, a portion of the nozzle 44 that meets the push button 40 and an upper portion of the push button 40 are pushed together such that the push button 40 is pushed to operate the airless pump 20 while the nozzle 44 is bent so that the cosmetic contents are discharged and used. Then, it is preferable that boss rings 46 or bosses 48 as shown in FIGS. 4A and 4B, or other structures for preventing a finger having pushed the nozzle 44 from being slid are formed, at upper portions of the nozzle 44 and the push button 40.

According to the present invention, the container body 10 may be directly filled with cosmetic contents but the cosmetics container may further include an inner container 12. That is, the inner container 12 has a cylindrical shape one side of which is opened, and a piston 14 for wiping the cosmetic contents in the inner container 12 may be coupled to the inner container 12.

An auxiliary shoulder 32 for easily coupling the airless pump 20 may be further provided between the shoulder 30 and the mouth 16 of the container body 10, and a cover 50 for preventing introduction of foreign substances may be coupled to upper sides of the push button 40 and the shoulder 30.

Hereinafter, an operation of the cosmetics container with a push button having a flexible upright nozzle according to the embodiment of the present invention will be described.

When, the cosmetics container according to the present invention is assembled, first, the piston 14 is coupled to the inner container 12, the cosmetic contents are filled in the inner container 12 through the mouth 16, and the inner container 12 filled with the cosmetic contents is inserted into the container body 10. Thereafter, after a packing is located at the mouth 16 of the inner container 12, a portion of the airless pump 20 is inserted into the mouth 16 of the inner container 12 such that a portion of the discharge passage 22 is exposed to the outside, and the auxiliary shoulder 32 covers the mouth 16 of the inner container 12 and the shoulder 30 covers the auxiliary shoulder 32. Thereafter, the push button 40 having the flexible upright nozzle 44 is coupled to the discharge passage 22 of the airless pump 20. The cover 50 covers the push button 40 to prevent contaminants such as dust from being introduced into the cosmetics container.

When the cosmetics container according to the embodiment of the present invention is used, the cover 50 is removed from the container body 10 as shown in FIG. 3A. The container body 10 is gripped, by one hand, the nozzle 44 is pushed by one finger, and the nozzle 44 is bent as shown, in FIG. 3B. The nozzle 44 is further pushed and an upper portion of the push button 40 is pushed while the nozzle 44 is bent such that the discharge opening 42 faces a lateral side as shown in FIG. 3C so that the airless pump 20 is operated.

If the airless pump 20 is pressed to be operated, the cosmetic contents in the container body 10 are discharged through the discharge passage 22 of the airless pump 20 and the discharge opening of the nozzle 44 so that the cosmetic contents can be used.

If a force pressing the nozzle 44 and the push button 40 is removed after the cosmetic contents are discharged to be used, the push button 40 is moved upwards to return to the original position by a resilient force of the resilient member of the airless pump and the nozzle 44 also returns to the original position due to its resilient material to foe formed as shown in FIG. 3A again.

The cosmetic contents discharged and then left in the nozzle 44 and the push button 40 exist after they are discharged and used, in which case since the nozzle 44 is formed uprightly and the discharge opening 42 faces upwards, the cosmetic contents in the nozzle 44 and the push button 40 are prevented from flowing out through the discharge opening 42.

Although the exemplary embodiments of the present invention have been exemplified and described until now, it will be appreciated that the scope of the present invention is not limited to the specific embodiments but the obvious range of the present invention also pertains to the scope of the present invention.

| [List of reference numeral] | |
|---|---|
| 10: a container body | 12: an inner container |
| 14: a piston | 16: a mouth |
| 20: an airless pump | 22: a discharge passage |
| 30: a shoulder | 32: an auxiliary shoulder |
| 40: a push button | 42: a discharge passage |
| 44: a nozzle | 50: a cover |

What is claimed is:

1. A cosmetics container with a push button having a flexible upright nozzle, the cosmetics container comprising:

a container body (10) filled with cosmetic contents and having a mouth (16);

an airless pump (20) mounted to the mouth of the container body to pump the cosmetic contents and having a discharge passage (22) through which the cosmetic contents are discharged; and a shoulder (30) for fixing the airless pump (20) to the mouth of the container body and preventing leakage of the cosmetic contents from the container body, wherein a push button (40) is circumferentially coupled to the discharge passage (22) of the airless pump (20), a nozzle (44) extends uprightly from an upper thickened portion of the push button (40) when the nozzle (44) is in an upright form, and the nozzle (44) is formed of a flexible material, wherein boss rings (46) or bosses (48) are formed on surfaces of the nozzle (44) and the push button (40) such that a finger is not slid when the nozzle (44) and the push button (40) are pushed by the finger, wherein the nozzle (44) in the upright form comprises a central vertical axis about which the nozzle (44) and push button (40) are axially symmetric and along which the discharge opening (42), the nozzle (44), the discharge passage (22) and the airless pump (20) are vertically coaxial, wherein the cosmetic contents are discharged by pushing the nozzle (44) in any radial direction from the central vertical axis such that the nozzle (44) is bent and the discharge opening (42) faces a lateral side and further applying downward force on the nozzle (44) to push downward on the push button (40), and wherein the nozzle (44) resiliently returns to the upright form when the nozzle (44) is released by the finger and the applied downward force is removed.

2. The cosmetics container of claim 1, wherein the nozzle (44) and the push button (40) are formed of a same flexible material or only the nozzle (44) is formed of a flexible material and the push button (40) is formed by using an in-mold injection mold, and the nozzle and the push button are formed of different materials through a dual injection-molding method or the nozzle (44) and the push button (40) are separately injection-molded and then are assembled.

3. The cosmetics container of claim 2, wherein the nozzle (44) is formed of one of nitrile rubber (NBR), natural rubber (NR), silicon rubber, and butadiene rubber (BR).

4. The cosmetics container of claim 1, wherein the cosmetics container further comprises an inner container (12) having a cylindrical shape one side of which is opened, and a piston (14) that is coupled to the inner container (12).

5. The cosmetics container of claim 1, wherein an auxiliary shoulder for easily coupling the airless pump is further provided between the shoulder (30) and the mouth (16) of the container body (10).

6. The cosmetics container of claim 1, wherein a cover (50) for preventing introduction of foreign substances is coupled to the shoulder (30) to cover the button (40).

7. The cosmetics container of claim 1, wherein the nozzle (44) is formed of one of nitrile rubber (NBR), natural rubber (NR), silicon rubber, and butadiene rubber (BR).

* * * * *